United States Patent [19]

Meagher

[11] 3,945,319

[45] Mar. 23, 1976

[54] BLASTING MAT

[76] Inventor: William Kevin Meagher, 2362 Islington Ave., Apt. 9, Rexdale, Ontario, Canada

[22] Filed: Oct. 24, 1974

[21] Appl. No.: 517,618

[52] U.S. Cl. ..... 102/22
[51] Int. Cl.[2] ..... F42D 5/00
[58] Field of Search ..... 102/22 BM

[56] References Cited

FOREIGN PATENTS OR APPLICATIONS

| | | | |
|---|---|---|---|
| 120,935 | 2/1948 | Sweden | 102/22 BM |
| 132,993 | 9/1951 | Sweden | 102/22 BM |

*Primary Examiner*—Verlin R. Pendegrass

[57] ABSTRACT

A modular section for use in assembling a blasting mat. The section is elongated with upper and lower faces and a pair of parallel side faces. Each side face is curved in a plane normal to the longitudinal axis of the section to form an overhanging portion along one lateral face and an outwardly projecting lower portion along the other lateral face, whereby sections may be fitted together in abutting relationship. Each section includes pressure port means and means allowing the interconnection a plurality of the sections to form the mat. Preferably the ends of the section are also parallel and curved in the vertical plane of the longitudinal axis of the section.

10 Claims, 4 Drawing Figures

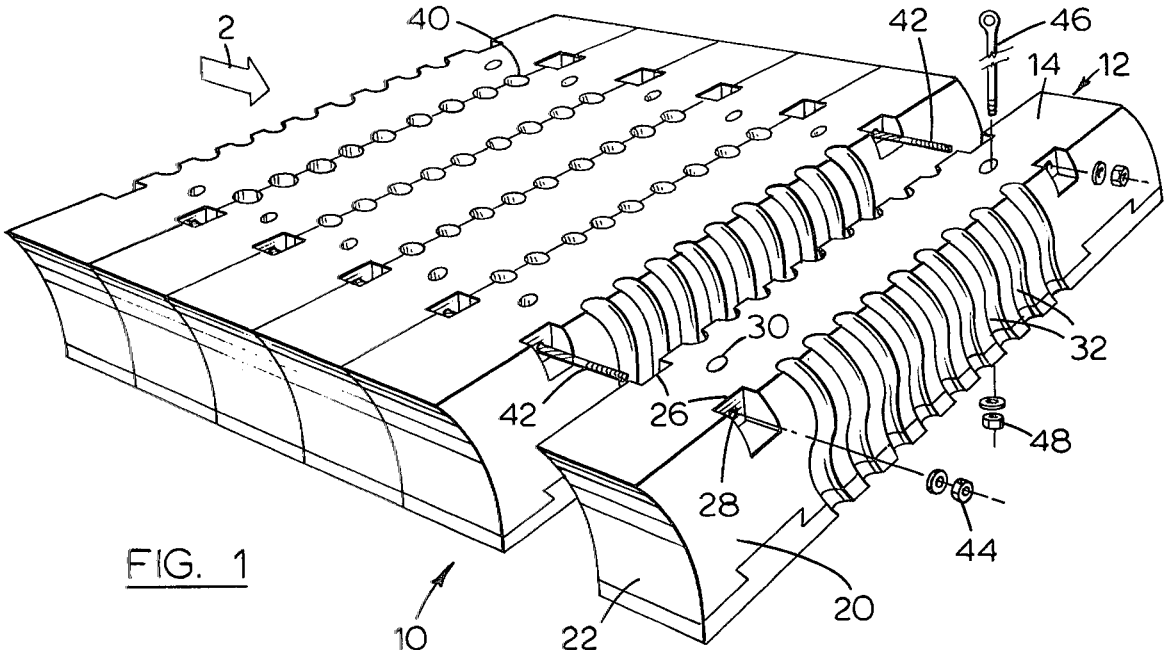
FIG. 1
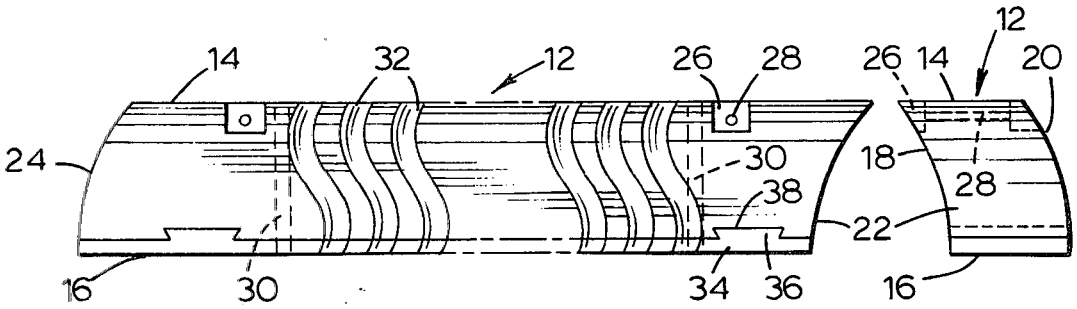
FIG. 2
FIG. 3
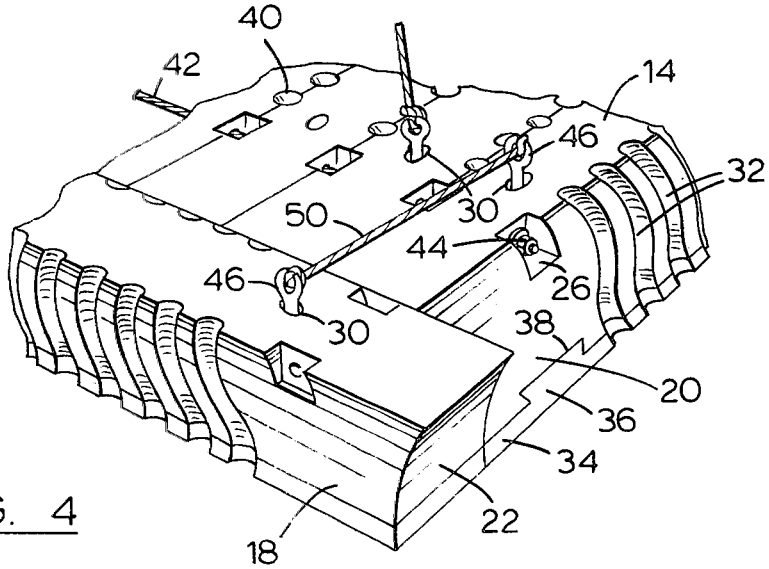
FIG. 4

BLASTING MAT

This invention relates to a blasting mat.

Blasting mats are used in excavating where areas of rock are being broken up by explosives. The purpose of the mat is to contain flying rock fragments. Presently such mats are constructed by sectioning the side walls of tires and stringing them together as shown in U.S. Pat. No. 3,331,322 issued July 18, 1967 to L. Belanger. A disadvantage of such mats is that, for the usual size used in blasting operations, they must be assembled beforehand, moved to the blasting site using a low truck bed, and lifted onto the site by crane. Also, such mats are prone to breakage by flying pieces of rock, generated by the blast, which penetrate between individual tire pieces and cut the stringers holding the pieces together.

It is an object of the present invention to provide a blasting mat which is sectional for ease of transportation and assembly.

It is another object of the present invention to provide a blasting mat which is rugged in use.

In its broadest aspect the invention consists of a modular section for use in assembling a blasting mat. The section is elongated with upper and lower faces and a pair of parallel side faces. Each side face is curved in a plane normal to the longitudinal axis of the section to form an overhanging portion along one lateral face and an outwardly projecting lower portion along the other lateral face, whereby sections may be fitted together in abutting relationship. Each section includes pressure port means and means allowing the interconnection a plurality of the sections to form the mat. Preferably the ends of the section are also parallel and curved in the vertical plane of the longitudinal axis of the section.

An example embodiment of the invention is shown in the accompanying drawings in which:

FIG. 1 is a perspective view of a blasting mat according to the invention;

FIG. 2 is a side view of one section of the mat taken in the direction of arrow 2 in FIG. 1;

FIG. 3 is an end view of the mat section shown in FIG. 2, and

FIG. 4 is a perspective view of the mat of FIG. 1 showing an alternate arrangement of the mat sections.

The embodiment shown in the drawings consists of a mat 10 comprising a plurality of uniform sections 12 which fit together in modular manner to form the mat. Each section is elongated and four-sided in transverse cross-section with a planar upper side 14, a planar lower side 16 parallel to upper side 14, a pair of parallel lateral sides 18 and 20, and a pair of parallel ends 22 and 24. Lateral sides 18 and 20, are curved in vertical cross-section whereby the upper portion of section 12 overhangs the bottom portion of the section on side 18, as seen in FIG. 3 of the drawings. Ends 22 and 24 are also curved in vertical cross-section whereby the upper portion of section 12 overhangs the bottom portion of the section on side 22, as seen in FIG. 2.

Each section 12 is recessed on both lateral edges of upper side 14 to form opposed pairs of wells 26 adjacent ends 22 and 24 of the section. A horizontal bore 28, extending through section 12 parallel to upper side 14, and normal to the longitudinal axis of the section, opens into each opposed pair of wells 26. A vertical bore 30 extends through each section 12 adjacent each horizontal bore 28. A plurality of sinous recesses 32 are located in opposed pairs on lateral sides 18 and 20 of each section 12. Each recess 32 is semi-circular in transverse cross-section and terminates at the lateral edges of upper and lower sides 14 and 16 respectively. Although only one bore 28 and one bore 30 may be present in section 12, two of each are preferable.

Lower side 16 of each section 12 comprises a face formed by a shoe 34 fixed by force-fitting wedge strips 36 of the shoe into corresponding wedge slots 38 in the section.

The material of each section 12 is preferably slightly flexible, for example hard rubber, which may be reinforced with wire stands. By using a shoe 34 of a lower grade rubber to absorb most of the shock, a less flexible material needs to be used for section 12.

In use, a number of sections 12 are placed side by side in abutting relationship as seen in FIG. 1 to form mat 10 covering a blast area. By abutting sides 18 and 20 of a pair of sections 12, recesses 32 are matched together to form air pressure relief passages 40. To secure sections 12 together, a tying cable 42 is threaded through bores 28 which are aligned. The ends of cables 42 are threaded to receive nuts 44 which lie in recesses 26 in those sections 12 which lie at the ends of assembled mat 10. Bores 30 receive anchor pins 46 which are secured by bolts 48. Anchor pins 46 are used to lift an assembled mat 10 onto the blast area if the mat is assembled adjacent the site rather than on top of the blasting area itself. To extend mat 10 in a second lateral direction two assembled rows of sections 12 may be used in abutting relationship with ends 22 abutting ends 24, or additional sections 12a may be placed laterally in abutting relationship as shown in FIG. 4 of the drawings. Tie cables 50 may be used with anchor pins 46, as seen in FIG. 4, to attach sections **12*a* to the main body of mat 10**.

It will be appreciated that the device of the present invention provides a blasting mat which may be easily and quickly assembled adjacent the site, or on the site, thus avoiding the need for low bed truck transportation. The curved shape of the side and end faces of each section of the mat prevents rock fragments from passing through the mat and also protects the tying cables from being cut by such fragments. Even if a tying cable is broken the mat can be repaired on the site. Also, the shape of the sections allows them to be assembled at 90° orientations as seen in FIG. 4, thus enabling small remaining exposed portions of a blasting area to be covered.

Preferably each section 12 is 4 feet long, 10 inches in vertical thickness and 8 inches in lateral thickness. Pressure relief ports 40 are preferably 3 inches in diameter, i.e. recesses 32 are 1½ inches deep, the recesses being spaced 3 inches apart. Cables 42 are preferably three-quarters of an inch thick and about 10 to 20 feet long with a bolt head at one end and a thread at the other end. Eye bolts are also preferably three-quarters of an inch in diameter. The preferable size of each section 12 enables it to be carried by an ordinary truck.

I claim:

1. For use in assembling a blasting mat, an elongated section of slightly flexible material having an upper side and a lower side and a pair of parallel lateral sides, each lateral side being curved in a plane normal to the longitudinal axis of the section to form an overhanging upper portion along one of said lateral sides and an outwardly projecting lower portion along the other of said lateral sides, pressure relief port means in the section, and means allowing the reception of interconnecting means for assembling a plurality of the sections in abutting relationship to form the mat.

2. A section as claimed in claim 1 in which the ends of the section are parallel and curved in the vertical plane of the longitudinal axis of the section.

3. A section as claimed in claim 1 in which the pressure relief port means comprises a plurality of sinuous recesses located in opposed pairs on the lateral sides of the section, each recess extending from the lower side to the upper side of the section.

4. A section as claimed in claim 1 in which the lower side of the section carries a shoe of flexible material forming a face thereon.

5. A section as claimed in claim 1 in which the means allowing the reception of interconnecting means comprises at least one bore extending between the lateral sides of the section parallel to the upper side thereof and normal to the longitudinal axis of the section.

6. A section as claimed in claim 5 in which the bore terminates in a well located in each side of the section.

7. A section as claimed in claim 1 including at least one vertical bore allowing the reception of gripping means.

8. A section as claimed in claim 1 in which the slightly flexible material of the section is hard rubber.

9. A section as claimed in claim 4 in which the flexible material of the shoe is low grade rubber.

10. A blasting mat comprising a plurality of modules secured together in abutting relationship, each module comprising an elongated section of slightly flexible material having an upperside and a lower side and a pair of parallel lateral sides, each lateral side being curved in a plane normal to the longitudinal axis of the section to form an overhanging upper portion along one of said lateral sides and an outwardly projecting lower portion along the other of said lateral sides, cable means passing through the plurality of sections and securing the sections together, and relief port means interconnecting the upper and lower sides of the assembled mat.

* * * * *